US008286966B2

(12) United States Patent
Golie

(10) Patent No.: US 8,286,966 B2
(45) Date of Patent: Oct. 16, 2012

(54) RELATIONSHIP GAMES

(76) Inventor: Tim Golie, Roseville, MN (US)

( * ) Notice: Subject to any disclaimer, the term of this patent is extended or adjusted under 35 U.S.C. 154(b) by 0 days.

(21) Appl. No.: 12/638,236

(22) Filed: Dec. 15, 2009

(65) Prior Publication Data

US 2011/0140360 A1 Jun. 16, 2011

(51) Int. Cl.
*A63F 3/00* (2006.01)

(52) U.S. Cl. ..... 273/236; 273/243

(58) Field of Classification Search ..... 273/236, 273/243; 463/9–14
See application file for complete search history.

(56) References Cited

U.S. PATENT DOCUMENTS 4,606,546 A * 8/1986 Rita ..... 273/269
4,682,777 A 7/1987 Wood
4,804,190 A * 2/1989 Hofmann ..... 273/250
5,230,518 A 7/1993 Crowe et al.
5,332,227 A * 7/1994 Passero ..... 273/243
5,735,522 A 4/1998 Sausa
6,017,035 A 1/2000 Glasser et al.
6,102,398 A * 8/2000 Kolleth ..... 273/252
6,224,056 B1 * 5/2001 Jones ..... 273/249
6,224,057 B1 * 5/2001 Morton ..... 273/272
7,040,622 B2 * 5/2006 Sebesta et al. ..... 273/236
7,441,777 B2 * 10/2008 Thompson ..... 273/243
7,802,793 B2 * 9/2010 Mahar et al. ..... 273/139

* cited by examiner

*Primary Examiner* — Vishu K. Mendiratta

(74) *Attorney, Agent, or Firm* — Thomas J. Nikolai; Nikolai & Mersereau, P.A.

(57) ABSTRACT

A series of games are disclosed which test the ability of players to ascertain and identify the existence of relationships between topics in a structured fashion. Players can play against each other or against pre-established standards.

20 Claims, 7 Drawing Sheets

WILL SMITH

Claim to Fame: Actor

Date of Birth: September 25, 1968

Location of Birthplace: Philadelphia, PA

Famous Family: Actress Jada Pinkett Smith (wife)

Nicknames/pseudonyms: None

Birthday Buddies: Actor Christopher Reeve, TV personality Barbara Walters, Actress Heather Locklear Famous costars: Tommy Lee Jones in the movie "Men in Black"; Whoopi Goldberg and Ted Danson in the movie "Made in America", Donald Sutherland in the movie "Six Degrees of Separation"; Kevin James and Eva Mendes in the movie "Hitch"; Jeff Goldblum, Judd Hirsch, Vivaca A. Fox, and Harry Connick Jr. in the movie "Independence Day"; Jack Lemmon in the movie "The Legend of Bagger Vance"; Martin Scorsese, Peter Falk and Angelina Jolie in the movie "Shark Tale; Jamie Foxx and LeVar Burton... in the movie "Ali"; Martin Lawrence in the movie "Bad Boys"; Charlize Theron and Matt Damon in the movie "The Legend of Bagger Vance"; Jon Voight and Jack Black... in the movie "Enemy of the State"; Stephon Marbury in a NY Knicks game in the movie "Hitch"

"Shared Identity": Portrayed the boxer Muhammad Ali in the movie "Ali"

Portrayed Jim West in the 1999 movie "Wild Wild West;Robert Conrad originally portrayed the same character in the 1960"s TV show of the same name.

Musical Connections: A "Duke" Ellington song is part of the soundtrack for "The Legend of Bagger Vance"; Justin Timberlake and Mary J. Blige are on the soundtrack of the movie "Shark Tale"

40

38

30

*Fig. 6*

RELATIONSHIP GAMES

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates generally to games, and more particularly to games which can be used for both educational and entertainment purposes and involve the use of various strategies and tools for identifying relationships which exist between people and events.

II. Description of the Prior Art

The prior art contains many different types of card games, board games, computer games and other types of electronic games. Many games, e.g., checkers and chess, involve varying degrees of strategy based on the skill of the players. These games, however, do not tend to spark wide-ranging discussion between players and also typically do not involve the use of research tools while the game is being played.

Other games use knowledge of trivia and similar types of data. Winning is predicated upon having in one's head the right set of facts. Neither research tools nor strategy are critical to winning. Prior art trivia games can also be very frustrating for players who are intelligent, but do not have a firm grasp of the subject area (e.g., popular culture) to which the questions comprising the game are directed.

The present invention solves the above-referenced problems and other deficiencies of prior art games by providing games involving not only knowledge, but also research skills and strategy regarding the identification of relationships. The games are designed in a way which stimulates conversation between players and spectators.

SUMMARY OF THE INVENTION

Games incorporating the present invention may be played in any number of formats, including but not limited to, a board game format, a scratch game format, a game show format, and a computer or Internet game format. The game may also be used as part of a promotion for goods or services (e.g., a bottle cap game used to promote the sale of beverages) or as general entertainment (e.g., a bar or restaurant game) to generate conversation. Irrespective of the format in which the game is played, the apparatus used to play the game typically includes a plurality of sets of game information. Each set of game information includes at least a unique topic. Topics can be the name of a person, place, thing, or historical event. The game also typically employs a game board used to test the ability of a player or multiple players to identify relationships existing between the topics of the plurality of sets of game information. The game board can be a physical game board or a virtual game board and the arrangement of the game board can be varied to present different levels of challenge to players and provide different formats for play of the game. One or more resources are also used for verifying the existence of relationships between the topics of the plurality of sets of game information. Some are used by players to identify or prove the existence of such relationships. Which resources may be used can be governed either by the sponsor of the game or, in some cases, by the player or players themselves. The game also includes a scoring system or mechanism used to evaluate the success of the player or players in identifying relationships between the topics and to determine who, if anyone, won the game. Players must either prove themselves more adept at identifying relationships than other players of some pre-established standard to prevail. This must be done in the context of the sets of game information, the structure of the game board and the rules of play.

The advantages of the present invention will become more fully understood from reading the detailed description provided below together with the drawings. The invention is, of course, defined by the claims set forth at the conclusion of the detailed description and the invention is not limited to the embodiments summarized above or described more fully below.

BRIEF DESCRIPTION OF THE DRAWINGS

FIG. 6 is a bottom plan view of a game card;

DETAILED DESCRIPTION

Figure 1:
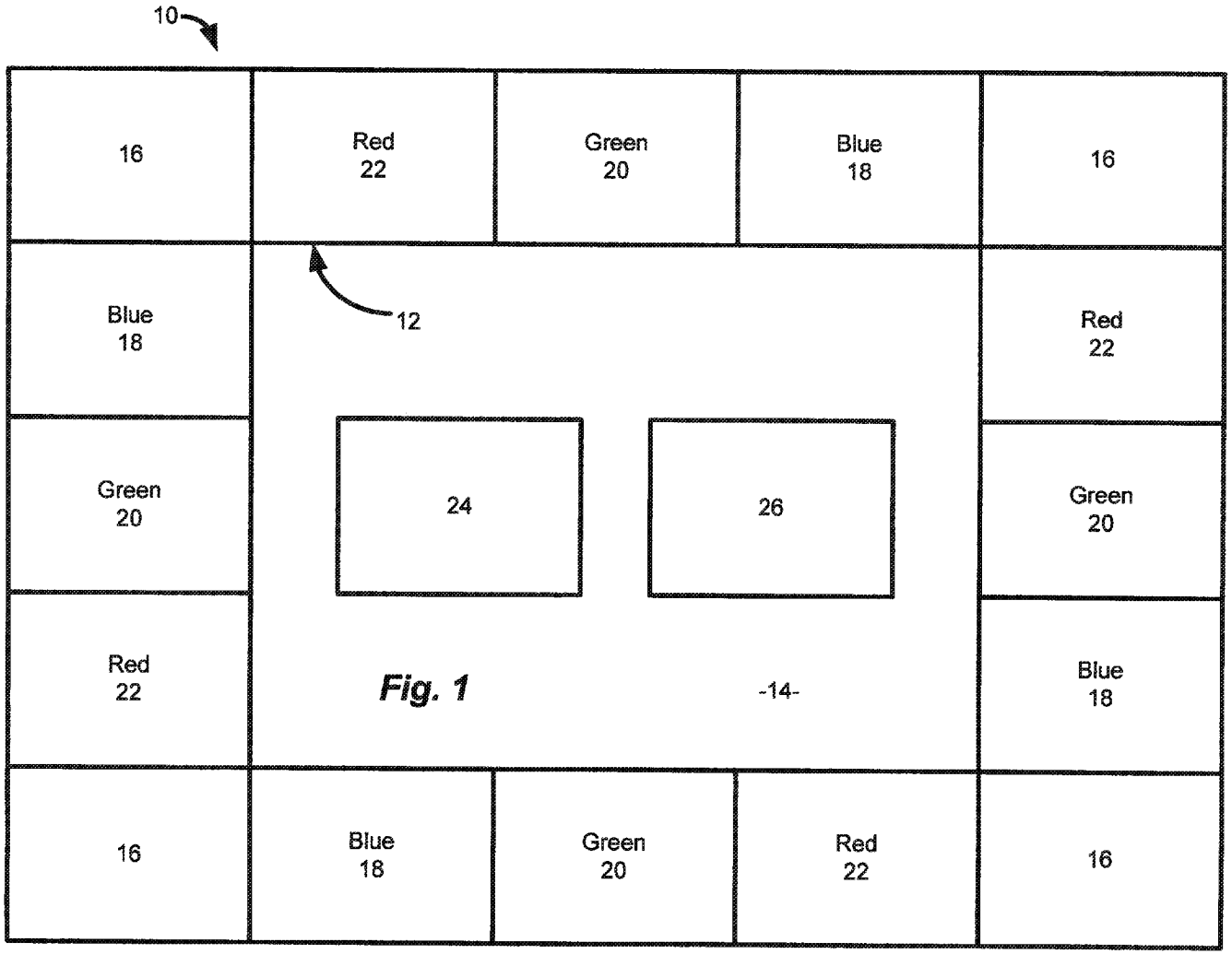
FIG. 1 is a top plan view of a game board.

FIG. 1 shows an exemplary game board arrangement. Other game board arrangements, such as those shown in FIGS. 3-4 and others, can be used without deviating from the invention.

The game board of FIG. 1 is arranged in a rectangular fashion having a border 12 and a center 14. The border 12 includes four corner spaces 16. Located between each pair of corner spaces 16 are three intermediate spaces each of a different type, namely a blue space 18, a green space 20, and a red space 22. The center includes two additional spaces 24 and 26. Space 24 is also coded with a color.

Those skilled in the game art will recognize various modifications can be made to the game board 10 without deviating from the invention. First, there can be a larger number of intermediate spaces which either repeat the colors of the intermediate spaces 18, 20 and 22 or are of different colors. Second, shapes other than a rectangle can be employed to increase or decrease the number of corner spaces. Third, coding mechanisms other than color can be used to distinguish the intermediate spaces 18, 20 and 22 and the center space 24. For example, different shapes, labels or patterns printed within the intermediate spaces 18, 20 and 22 and center space 24 could be used to distinguish them.

Figure 5:
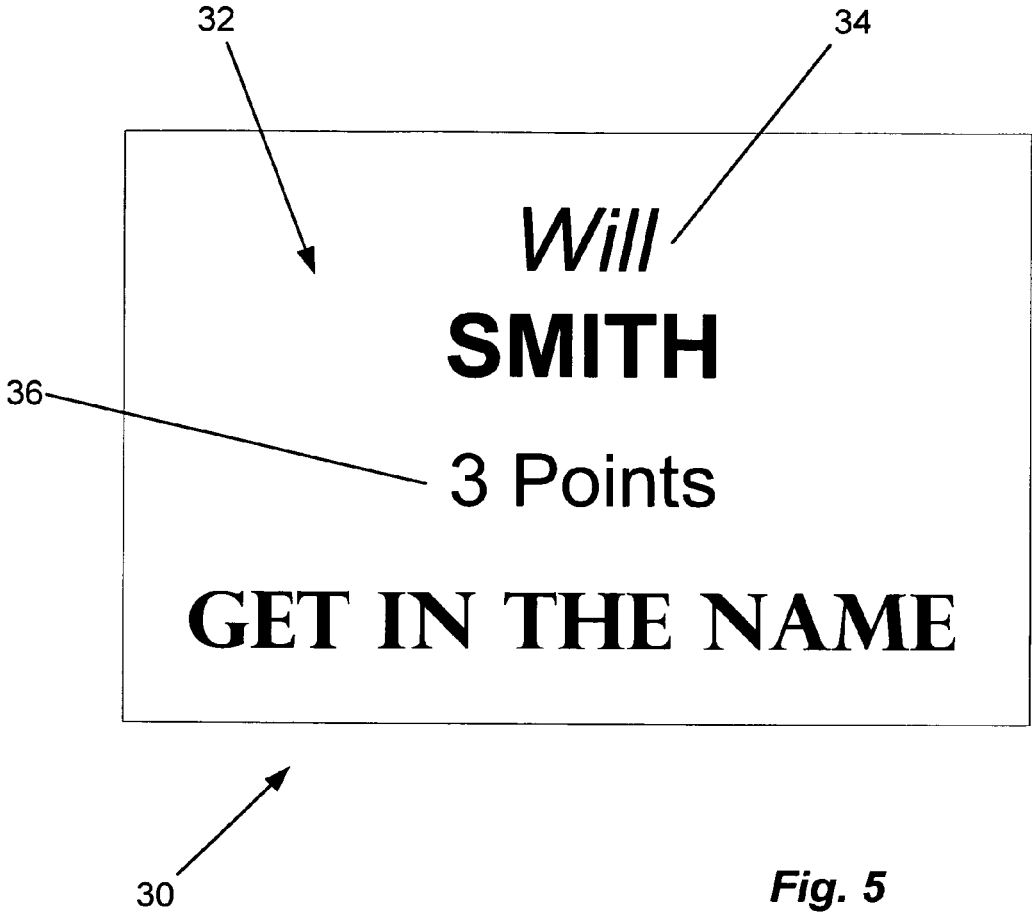
FIG. 5 is a top plan view of a game card.

A plurality of game cards 30 are used with the game board 10. As shown in FIG. 5, each game card has a top 32. Printed on the top 32 of each game card 30 is a topic 34 which can be a person, place, thing or event. Also printed on the top 32 is a point value 36. As shown in FIG. 6, the back 38 of each game card has a listing of data 40 related to the topic 34 printed on the top 32 of the game card 30. The information printed on the front and back of the game card shown in FIGS. 5 and 6 is an example of one set of game information. Other cards used in playing the game will include different sets of game information. Also, the cards can include, in addition to text, information printed in graphical form such as photographs or drawings associated with the topic 34. While the type and quantity of game information may vary, each set will include at least a topic 34.

The game cards 30 are divided into groups. The number of groups matches the number of types of intermediate spaces of the game board 10 plus one for the center space 24. Three types—blue, green and red—of intermediate spaces are shown in FIG. 1. Thus, when the game board 10 of FIG. 1 is used, there will be four groups of cards—one colored blue, a second colored green, a third colored red and a fourth corresponding to the color of space 24. When patterns, shapes or labels are printed in the spaces and used instead of colors to identify a type of space, the same patterns, shapes, or labels are printed on the cards of the group of cards to be associated with a particular type of space.

In addition to the game board 10 and cards 30, game equipment also includes a timer (not shown) which can be an hourglass, a mechanical clock, an electronic timer, or any other suitable timer. Game equipment may also include a set of blank cards (not shown) and a set of marker pieces (not shown). The game equipment may also include one or more copies of at least one reference work. The copies of the reference work can be in any form. Examples include a book, pamphlet, software containing disk (e.g., CD, DVD or Blue Ray), or an on-line resource. While the game can be played using a reference work supplied with the game, players can agree to use one or more other reference works (hereinafter authoritative works) either to replace or supplement the reference work(s) provided with the game.

When the board game format is employed, the game is most advantageously played by two or more contestants or two or more teams of contestants. As used hereinafter, the term "player" refers to a contestant or a team of contestants. A dealer begins by thoroughly shuffling the group (i.e., deck) of game cards 30 corresponding to space 24. Another player draws one of the cards from this deck and places it on space 24 so the topic is facing up. The dealer then forms a second deck of the cards corresponding by color or other coding scheme to spaces 18, 20 and 22, shuffles these cards and deals a predetermined number of these cards to each player. The remaining cards of this deck are placed on space 26. Each player is also given a predetermined number of blank cards and a predetermined number of marker pieces. Players then take turns placing cards from their hand on the game board as described below.

Play begins when a first player places a card of any color on one of the corner spaces 16 with the top 32 of the card 30 facing up. At the same time the player identifies a relationship existing between the topic 34 of the card 30 placed on the space 16 with the topic 34 of the card 30 previously placed on space 24. Of course, if the relationship's players are allowed to use became too tangential or vague, the game becomes too easy and less interesting. The game producer, of in some cases the players, will typically establish a set of relationship types which may be used when playing. Examples of relationship types which may be employed when the topics 34 are famous people include, but are not limited to:

family—married or other direct family relation;

co-stars—appeared together in movie, television show, commercial or play;

birthdays—born on the same day of the same month, but not necessarily the same year;

sports—share the same professional uniform number;

music—performed in the same musical group, co-wrote songs, had their music played as part of the same score of a movie, play, television show or commercial;

shared identity—actors who played the same role, or a person and the actor who played that person in a movie, play or television.

A variety of other relationship types may be identified in the rules of play and deemed acceptable for use so the foregoing list is not intended to be limiting, but rather exemplary.

After a player has played a card and identified a relationship, the next player in turn can then either accept that such a relationship exists or may challenge.

In the event of a challenge, a timer is activated. The player playing the card 30 must then prove the relationship before time expires. The player can prove the relationship using the data 40 on the cards placed on spaces 16 and 24, using a reference work supplied with the game or using another authoritative work. If a player successfully proves the relationship exists during the allotted time, the player presenting a challenge must draw another card from the top of the deck which was placed on space 26 as a penalty for presenting an unsuccessful challenge. If a player playing a card fails to prove the relationship exists during the allotted time, that player must pick up the card played and draw another card from the deck as a penalty. Play continues with players taking turns in this fashion until cards have been successfully placed by players on each of the four corner spaces 16.

Once all of the corner spaces 16 have been covered with a card, players can continue to place cards on the corner spaces 16 or can place cards on the colored intermediate spaces 18, 20 and 22. Only cards having a color matching a space 18, 20 and 22 can be placed on that space. Players can also begin using the blank cards 52 and marker pieces 54 at this point.

Whenever a player places another card on a corner, the player must announce a relationship between the topic of the card the player is placing and the topic of each adjoining card. In this case, the adjoining cards include the card placed in space 24, the previous card already on the corner space on which the player is placing the card being played, the adjacent card in the clockwise direction and the adjacent card in the counterclockwise direction. The next player in turn may challenge one or more of the announced relationships. The player placing the card must prove the existence of each challenged relationship(s) within an allotted time. The length of the allotted time will vary based upon the number of relationships challenged. If there is no challenge or if the player is able to prove the existence of all of the challenged relationships, the player placing the card gets another turn. Any player losing a challenge must pick another card from the deck for each challenge lost. For example, if the player challenges two relationships and loses both, the challenger must draw two cards from the deck. If the challenger presents two challenges and one is successful and the other is unsuccessful, the challenge must draw one card from the deck. If any of the challenges are successful, the player who played the card loses his turn, must draw a card from the deck on space 26 for each successful challenge, and also must pick up the card played.

Once all the corner spaces are filled, a player may also place a card on one of the intermediate spaces 18, 20 and 22. However as indicated above, a card placed on an intermediate space must be coded the same way as the space. When a player places the card, the player must announce a relationship between the topic of the card being placed with the next card on the game board in the clockwise direction and the next card on the game board in the counterclockwise direction. The next player in turn may challenge either of the two identified relationships. If there is no challenge or if the party successfully proves the existence of any and all challenged relationships, the player may elect to take another turn. The player may decline to do so without penalty. However, if there is a successful challenge, the player loses his turn, must pick up the card played and draw from the deck on space 26 a number of cards equal to the number of successful challenges. Any party losing a challenge must draw from the deck a number of cards equal to the number of challenges lost.

Players may skip their turn without playing any cards. The penalty for doing so is drawing another card from the deck on space 26. No penalty will be imposed if a player has already successfully played a card during the player's turn, but declines to play another card.

Players may also use blank cards on any space by writing a topic on the card and announcing the relationships required to place a card on a particular space, i.e., one if the card is placed on a corner and there is no other card on the corner, two if the card is placed on an intermediate space, and four if the card is placed on an already occupied corner space.

A player may also use a marker piece when placing a card on an intermediate or corner space. By playing a marker piece, the player avoids the need to announce one of the required relationships to play the card. For example, if a card is placed on one of the intermediate spaces and the marker is placed clockwise of the card, the player then only needs to announce and potentially prove a relationship between the topic of the card being played and the topic of the closest card in the counterclockwise direction of the card being played. Likewise, if a player places a card on a corner, the player may use the marker piece to avoid the need to prove one of four relationships, i.e., between the topic of the card being played and the topic of the next clockwise card, the next counterclockwise card, the card on space 24, or the card on the corner beneath the card being played.

Play continues until the earlier of each space on the board is being occupied with a card or a player having no cards left in the player's hand. In the first case, the players total up the point values on the cards still in their hand and the person with the lowest total of points wins. In the second case, the player with no cards left in the player's hand wins. Blank cards still in hand are ignored when determining which player is the winner. Multiple games can be played as part of a match. The player with the lowest total number of points in all of the games of the match is the winner.

Figure 2:
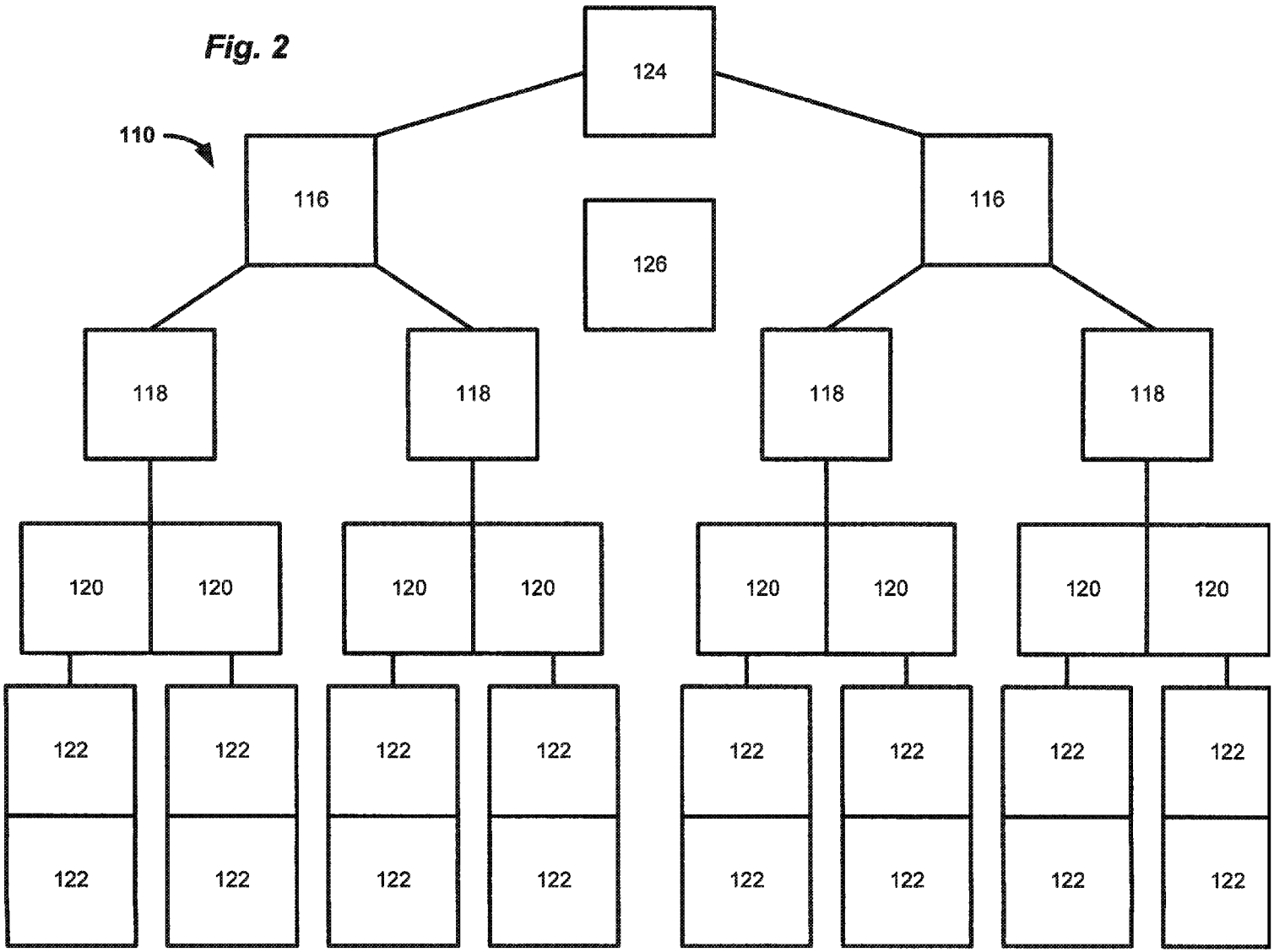
FIG. 2 is a top plan view of a second game board.

FIG. 2 shows an alternative game board 110. Game board 110 has spaces 124 and 126 which serve the same function as spaces 24 and 26, respectively, of FIG. 1. The spaces 116 of game board 110 are similar to the corner spaces 16 in that any color card can be played on these spaces. Spaces 118, 120 and 122 are coded in a fashion similar to the spaces 18, 20 and 22 of FIG. 1. Only cards coded (e.g., colored) the same way as these spaces can be played on these spaces. The game board 110 also has lines connecting space 124 with spaces 116, lines connecting each space 116 with two of the spaces 118, lines connecting each space 118 with two spaces 120 and lines connecting each space 120 with two spaces 122.

When the game board 110 is used, players start from the top at space 124 and generally work their way down the pyramid toward the bottom. A player need only identify a single relationship when placing a card on an open space, namely a relationship between the topic of the card being played and the topic of the card already played in the space in the row above connected by a line. A player can stack cards on any of spaces 116, 118 or 120. When a player elects to do so, however, the player must identify a relationship for the topic of each card placed in an adjoining space. For example, if spaces 116, 118 and both 120 spaces are occupied in a branch of the pyramid and a player wanted to play a card in space 118, the player would have to announce and prove, if challenged, a relationship between the topic of the card being played in space 118 and the cards already in spaces 116, 118 and 120 of that branch. Marker pieces, blank cards, and the timer are all used the same way as with the game board of FIG. 1. Also, challenges and rewards and penalties related thereto work in a similar fashion.

When the game board 110 is employed, a winner is determined either when a player no longer has any non-blank cards in hand or when all the spaces on the board are filled.

Figure 3:
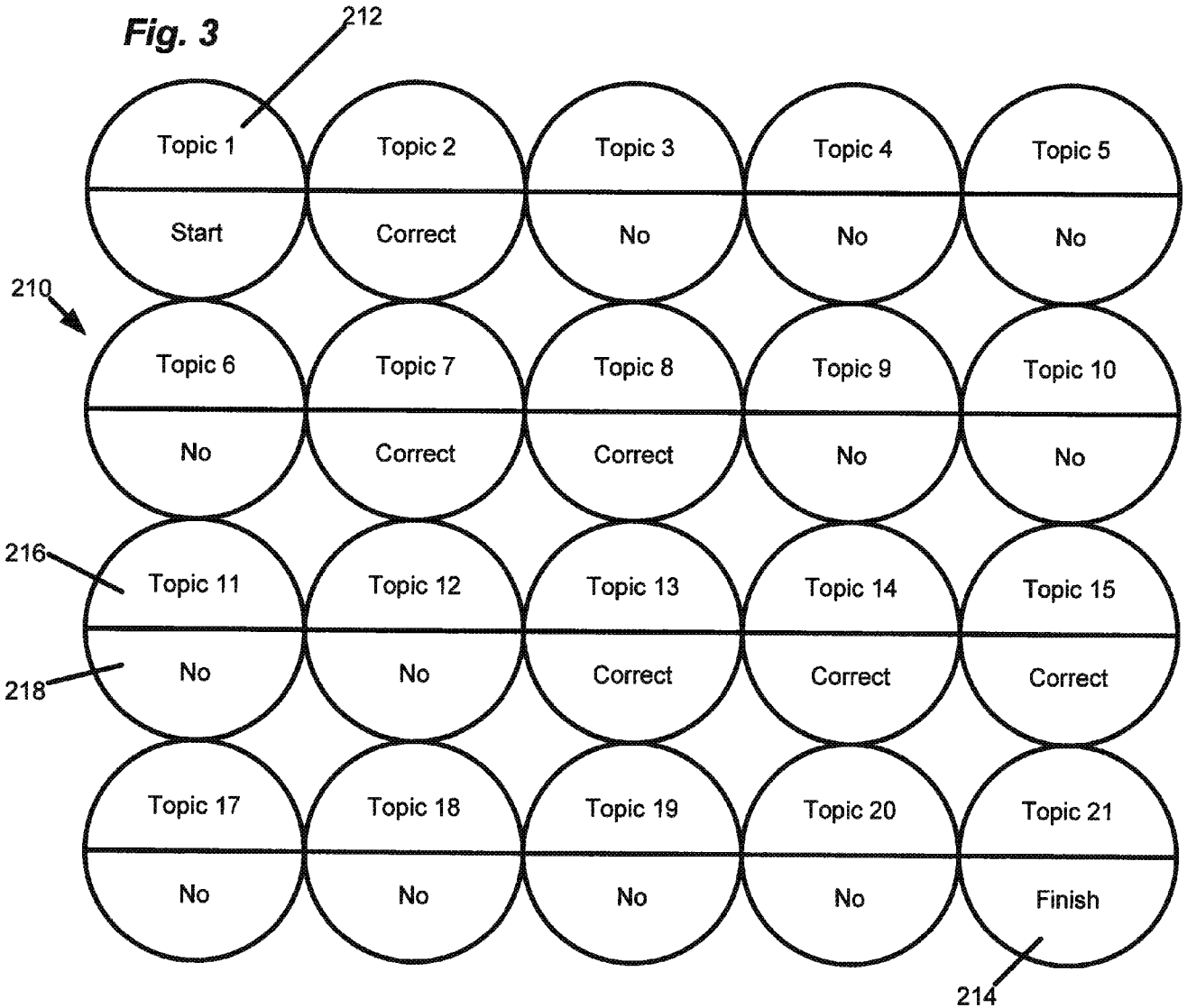
FIG. 3 is a top plan view of a third game board.

FIG. 3 shows a game board 210 designed in a fashion similar to a scratch-off lottery ticket. The game board 210 comprises a substrate on which cells and labels within cells are printed. Each label includes a topic 216 and an indicia 218 of whether the topic selected is correct or not. The indicia can be words such as "correct" and "no", colors such as green and red or any other suitable indicia. The topics for each cell are always left exposed, but the indicia of whether the topic is right or wrong printed on the substrate are covered with an opaque scratch-off covering in a manner familiar to those skilled in the art.

A player studies the card and tries to determine the right path from a start cell 212 to a finish cell 214. The path is only correct if a suitable relationship exists between the topics of each adjoining cell along the path. Once a player determines the path he wants to follow from the start cell to the finish cell, the player begins scratching off the coverings revealing the underlying indicia 218 to determine whether the selected path is correct or not. A player wins if a path from start to finish is completed without exposing any "no" cells.

Figure 7:
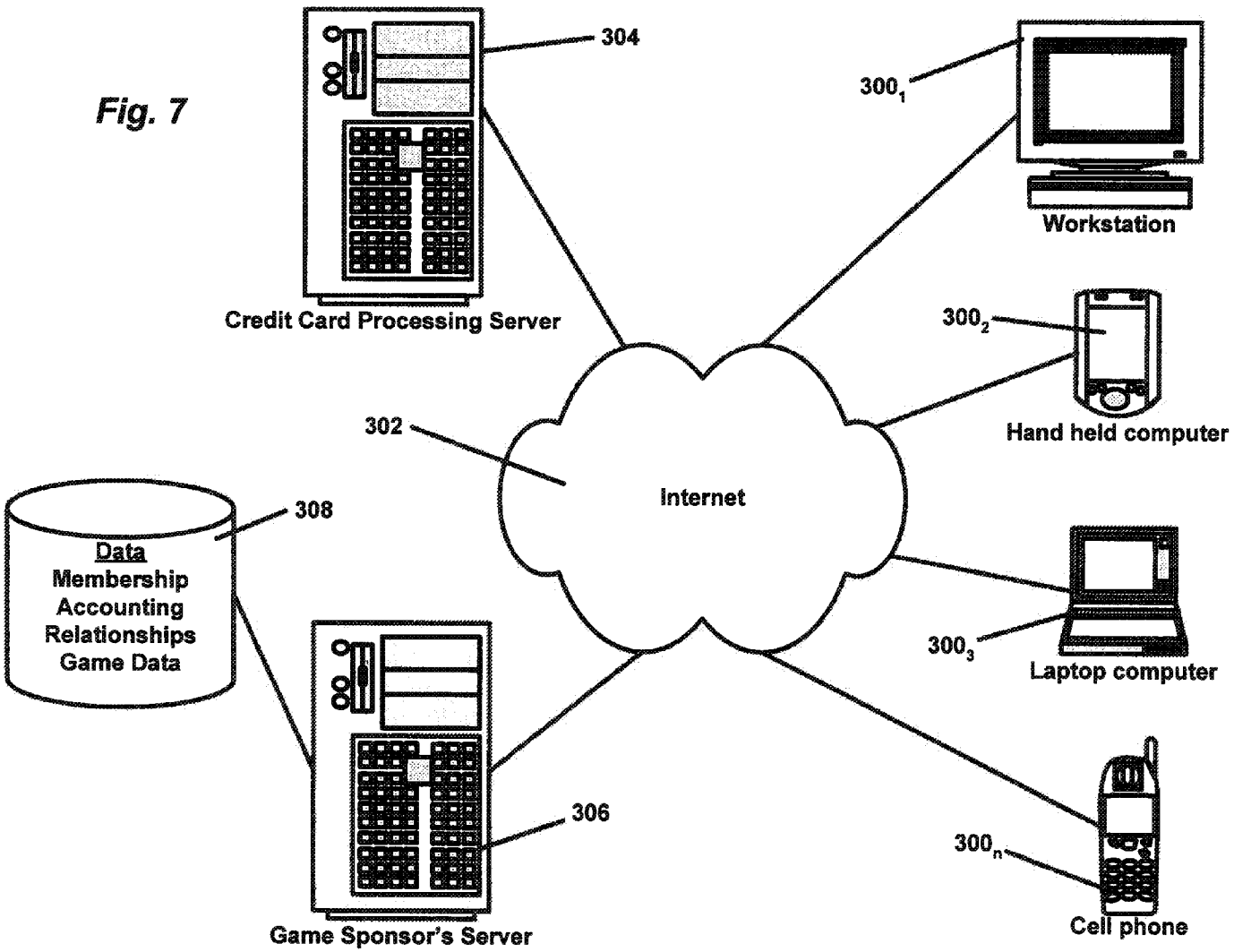
FIG. 7 is a schematic diagram related to an Internet version of the game.

The present invention is also well suited for an Internet contest where players, having paid a membership fee, are allowed to play for financial rewards. FIG. 7 shows a typical arrangement wherein a plurality of players play using workstations $\mathbf{300}_1$-$\mathbf{300}_n$ have access to the Internet 302. As suggested by FIG. 7, the workstation can be virtually any device capable of accessing the Internet including desktop computers, hand-held computers such as personal digital assistants, laptop computers and cell phones. Players authorize entrance fees or membership charges to be paid via the Internet just as many other credit card transactions are carried out. Hence, FIG. 7 shows a credit card processing server 304. The game is controlled by a central computer such as server 306 having access to one or more databases 308 used to carry out membership and accounting functions. The databases 308 also contain topic, relationship and any other game data used in playing or managing the game. The computer 306, in essence, acts as the game cards and reference work of the board game version. Additionally, the main computer 306 controls the rate of play replacing the timer of the board game, the dissemination and collection of data necessary to play the game, the imposition of penalties and points and the awarding of rewards and prizes.

Figure 4:
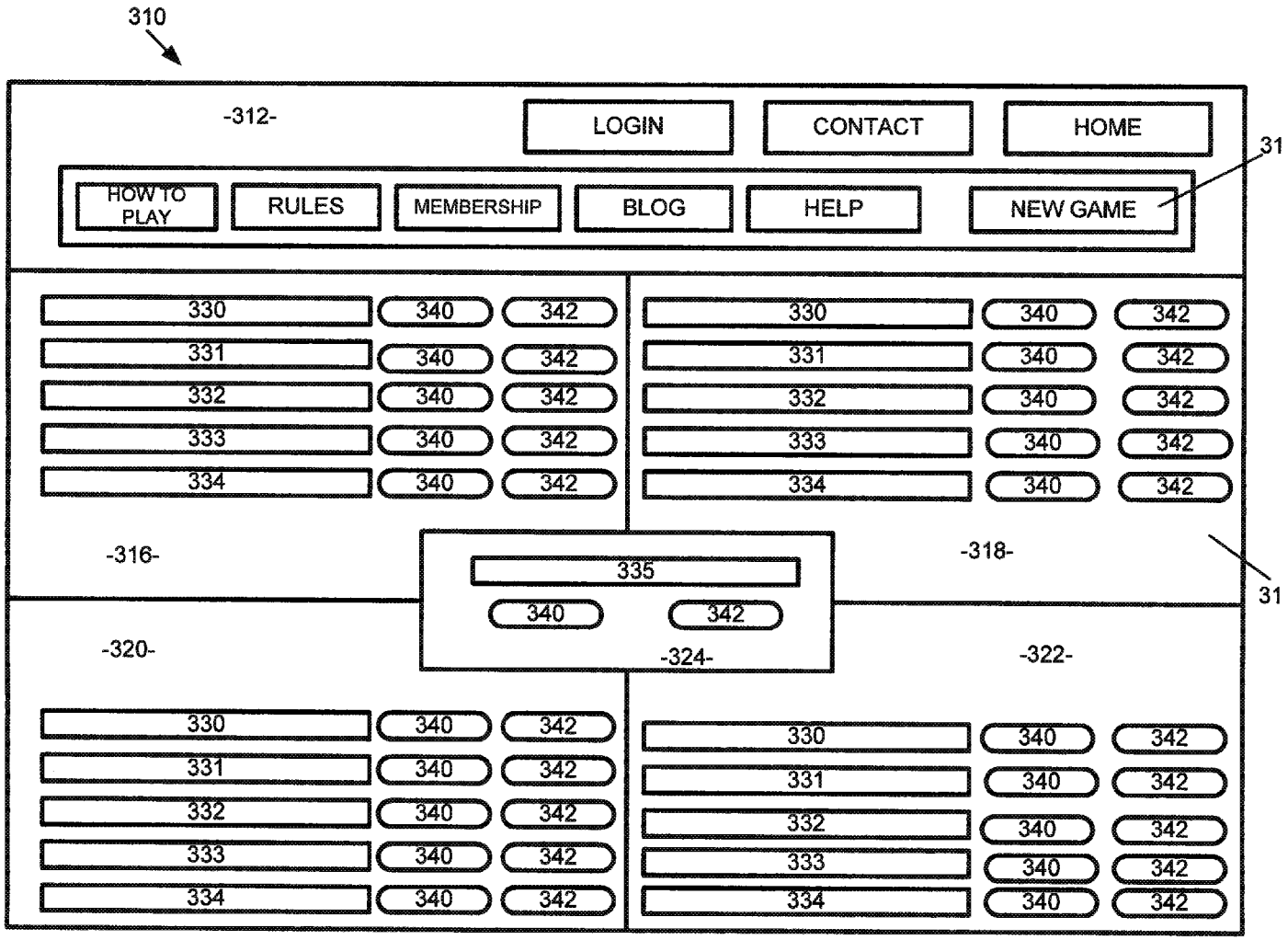
FIG. 4 is a top plan view of a fourth game board.

A player interface 310 displayed on the workstation of each player is shown in FIG. 4. This user interface allows each player to communicate with the main computer.

The user interface has various fields which can be accessed using a mouse (or other pointing device) and/or a keyboard and is divided into two sections—a menu section 312 and a play section 313. The menu section 312 includes fields used by players to log in, contact the game provider, or return to a home screen. The menu fields allow a player to gain an overview of the game; review the official rules; review, update, change or cancel the player's membership; review or provide blogs related to the game; or obtain general help.

The play section 313 of the user interface is essentially a virtual game board. The play section 313 is divided into four quadrants 316-322 and a center section 324. Each quadrant includes five fields 330-334. The center section includes a single field 335. Associated with each field 330-335 are two buttons 340 and 342. Buttons 340 are used to retrieve information which will appear in the field (e.g., clues related to the associated field) and buttons 342 are used to lock in answers a player types into the associated field 330-335.

As noted above, timing is controlled by the central computer 306. The game sponsor, via the computer 306, can control the time period during which the game can be played and can even control the time period during which a player can access clues or submit answers for one or more of fields 330-335. Colors, patterns, words or symbols can appear in the field to advise the player of issues related to time.

What follows is a discussion of one of many Internet games falling within the scope of the invention.

First, a player using an Internet browser on a workstation $\mathbf{300}_1$-$\mathbf{300}_n$, accesses a website operated by the game sponsor and the user interface 310 appears on the player's workstation. The player then clicks on the LOGIN button and enters a user name and password. The user name and password are transmitted to the main computer 306 which checks database 308 to verify the player has an active membership and has paid all fees necessary to play the game. If playing does not require payment of a fee, the step of verifying payment is skipped. If not, the player is prompted to allow the game sponsor to charge such fees to the player's credit card and does so upon receipt of the player's authorization. Within a few seconds, the credit card transaction is processed by server 304 and a signal is sent to the server 306 to the user's workstation $\mathbf{300}_{1\text{-}n}$ authorizing play. The player then hits the new game button 314 on the user interface and certain fields of the game board are populated. For example, each of the fields 330 could be populated with a separate topic and each of the fields 331 could be populated with a clue about a relationship existing between the topic entered in the adjacent field 330 and the topic to be entered in the field 331 where the clue appears.

At this point, the player can type a topic into one of the fields 331, conduct independent research to help the player identify the correct topic to enter into the field 331, or actuate the button 340 to obtain one or more additional clues from the server 306. When the player wishes to supply the topic for a field 331, he types a topic name into the field 331 and actuates button 342 associated with that field. When button 342 is actuated, the workstation $\mathbf{300}_{1\text{-}n}$ transmits the information entered in the field 331 to server 306 which immediately verifies whether the topic entered by the player into field 331 is correct and transmits a message back indicating whether the entered topic is correct or not. If the guess is not correct, the lettering in the field 331 turns red. If the guess is correct, the lettering in field 331 turns green and a clue appears in the adjoining field 332. Of course, other indicia other than a color change can be used to signify whether a guess was correct or not. The player can try to ascertain the topic to be filled into the field 332 using any of the strategies available to correctly identify the topic of field 331. Alternatively, the player can try to ascertain the correct topic for a field 331 in one of the other quadrants. This process continues until the fields 330-334 in at least one of the four quadrants 316-322, if not all four quadrants, are filled in with correct topics.

Game rules are established to determine when a player can try to guess the identity of the topic to be filled into field 335. Under one set of rules, such a guess can be made at any time and the game ends for the player once the correct topic is entered in field 335. Since the topic of field 334 in each of quadrants 316-322 is related to the topic of field 335, determining the correct answers for the fields 334 in each quadrant provides substantial and significant information a player can use when trying to identify the topic of field 335. The clue button 340 associated with field 335 and other research tools also provide information useful in identifying the topic to be filled into field 335. In other embodiments, the rules may require one, two, three or all four quadrants be completed before a player can supply a guess for the topic of field 335.

The Internet version of the game can be structured so the player is playing alone or competing with other players throughout the world. In either case, winners of the game are identified by the server 306 based on a point system. Points for each player are tracked by server 306. Points are accumulated by a player based on the time it takes for the player to complete the game board, the number of additional clues the player needed to access to complete the game board, and the number of wrong answers entered. When competing with other players, the player with the lowest point total successfully identifying the topic of field 335 is the winner. When playing alone, the player wins if the player is able to correctly identify the topic of field 335 without exceeding a predetermined point value. Again, points are automatically assessed by the server 306 based on elapsed time, the number of clues required and the number of erroneous guesses.

Prizes can be automatically awarded to players in a number of ways. Prizes can be awarded based on how a player places in an overall competition with other players. Players can also receive rewards based on how quickly those players ascertain the identify of the topic for a particular field other than 335 or how quickly the player completes an entire sequence comprising all of the fields 330-334 in a quadrant. Likewise, the reward can be a function of the number of points the player accumulates when playing the game.

The game can be designed to discourage random guessing of topics in a number of ways. First, the game can be designed to require fields 330-334 be filled in with topics in order. Second, the game can be designed to require all four of the fields 334 in quadrants 316-322 be completed before one can enter a topic in field 335. Third, erroneous entry of topics in a field can be penalized using points. Fourth, erroneous guesses can result in a field, the fields of a quadrant, or even all the fields be locked for a predetermined period of time preventing further play by the player in the field, quadrant or even the game until the lock out period expires.

The sponsor of the Internet game can also hold periodic (e.g., weekly) contests with a new set of clues and a new set of relationships. The publisher of a scratch-off version of the game as discussed above with reference to FIG. 3 can publish new cards based on different topics and sets of relationships. The range of topics and relationships is unending. Likewise, the publisher of the board game version of the game can periodically publish new sets of game cards 30 containing different sets of topics. Sets of topics related to people can, for example, relate to movie stars, musicians, world leaders, and historical figures. Sets of topics related to places can, for example, relate to landmarks, art, geology, geography, or social customs. Topics related to things can, for example, relate to buildings, technology and inventions, plants and animals, discoveries, mathematics or health. Topics related to events typically will focus on relationships between historical figures and occurrences.

Irrespective of whether a board game, scratch card, Internet version, or any other version of the game is employed, the game always includes certain attributes. First, the sponsor of the game always provides a plurality of sets of game information and each set of game information includes a unique topic. In any of the board game versions discussed above, the information printed on each of the individual cards 30 constitutes a separate set of game information. As noted above, printed on the top 32 of each game card 30 is a topic 34.

Printed on the back 38 is a listing of data related to the topic 34 which, together with the topic 34, constitutes a separate set of game information. Similarly, the Internet version of the game discussed above has a separate set of game information associated with each of the fields 330-335. The set of game information includes the correct topic associated with the field and the clues associated with the topic. These clues can appear automatically in the field or can be accessed by actuating the button 340 associated with a particular field 330-335. In the scratch-off version of the game, the information contained in each of the plurality of separate sets of game information is more limited and typically only included a unique topic. The sponsor of the game, irrespective of its form, can expand or contract the amount of game information provided in each set as desired, provided each set includes at least a unique topic.

A second attribute common to each version of the game is a predefined set of relationship types which may be used by the players. As noted above, the predefinition of acceptable relationship types allows the degree of difficulty to be readily adjustable and can be used to keep the game interesting for all levels of players.

A third attribute common to each version of the game is a game board used to test in a proscribed fashion the ability of the player or players to identify relationships between topics of the plurality of sets of game information. Whether a player is playing a board game version, a scratch-off version, a computer or Internet version or any other version, a game board is provided including a series of spaces and play requires the player to identify the existence of relationships between topics associated with adjacent spaces either by the sponsor of the game or the player of the game. In the board game version, a player may generally only play a card on a space if the player can identify a relationship between the topic of the card the player is playing and the topic of at least one other card already present on at least one adjacent space. In the Internet or computer version, the player must similarly identify topics having a relationship with a topic appearing in at least one adjacent space. In the scratch-off version of the game, to be successful a player must identify a correct path through a series of intermediate cells from a start cell 212 to a finish cell 214 based on the topics appearing in adjacent cells and the relationships (or lack thereof) between the topics listed in adjacent cells. Whether any of these or other game boards are used, the game board is used to provide a structure which tests the ability of the player or players to identify relationships between topics of the plurality of sets of game information.

A fourth feature all versions of the game have in common is the use of a resource to verify the existence of relationships (or lack thereof) between the topics of the plurality of sets of game information. In the Internet or scratch-off versions of the game, the resources used for verification are selected by the sponsor of the game who acts as a game judge. In the board game versions, these resources can include data printed on the cards 30, one or more other resources packaged with the game, or any other resource or set of resources selected by the player or players. In board game versions, the players make a final decision based upon the resources or resources used whether a relationship declared by a player exists.

Still another attribute common to all versions of the game is a scoring mechanism to evaluate the success of a player or players in identifying relationships between the topics and determine who won the game. In the board game version, scoring is based on points printed on the cards 30. In the Internet or computer version, scoring can be based on elapsed time, clues required, incorrect guesses or other criteria. In the scratch-off version, scoring can be an all-or-nothing proposition, either the player guesses all of the relationships correctly and wins or makes a mistake and loses. Alternatively, scoring can be based on the number of correct relationships identified before an error occurs or on the total number of errors made before all of the correct relationships are identified.

As should be clear from the foregoing discussion, the game can include other attributes without deviating from the invention. Such attributes can relate to timing of play, providing a player with the opportunity to identify a topic rather than those dictated by the game sponsor or providing a player with an opportunity to avoid the need to identify a relationship between a pair of topics at some limited number of points in the game.

The foregoing description of the invention and various embodiments are intended to be illustrative and not limiting. Numerous modifications and changes will readily occur to those skilled in the art. Accordingly, all modifications to what has been described above falling within the scope of the claims set forth below, and all equivalents thereto, are intended to be covered.

What is claimed:

1. A relationship identification game played by at least one player comprising:

a. at least one computer accessible database including (i) a plurality of separate sets of game information, each set of game information relating to a unique topic, and (ii) a predefined set of relationship types, at least one of the relationship types of the predefined set of relationship types selected from a group consisting of: family, co-stars, birthdays, sports, music, and shared identities;

b. a workstation having a user interface comprising (i) a display displaying a game board comprising a plurality of cells arranged such that each cell is adjacent at least one of the other cells of the plurality of cells, and (ii) at least one user input means used by a player for providing a proposed association of a unique topic with a cell of the plurality of cells; and c. game server means in communication with the at least one database and the workstation and operating under program control, for (i) receiving from the workstation the proposed association, (ii) verifying the existence of a relationship type of the predefined set of relationship types between the unique topic proposed for association with a particular cell and any unique topics already associated with immediately adjacent cells of the plurality of cells, and (iii) only permitting a unique topic proposed for association with a cell to be associated with that particular cell when the unique topic proposed has a relationship type of the predefined set of relationship types with each of the unique topics previously associated with any cell immediately adjacent to that particular cell.

2. The game of claim 1 wherein said game server means further comprises means for also evaluating a player's ability to propose topics permitted to be associated with a particular cell, and reporting to the workstation a score based, at least in part, on point values assigned to the unique topics proposed by the player and associated with cells.

3. The game of claim 2 wherein the score is based, at least in part, on the time it takes a player to propose a unique topic permitted to be associated with a cell.

4. The game of claim 2 wherein the score is based, at least in part, on a player proposing a unique topic which is not permitted to be associated with a particular cell.

5. The game of claim 4 wherein the game server further comprises means for assessing a penalty against a player for proposing a unique topic which is not permitted to be associated with a particular cell.

6. The game of claim 5 wherein the penalty is an assessment of a number of points.

7. The game of claim 5 wherein the game server assesses a penalty against a player by prohibiting the player from providing a proposed association of a unique topic with a cell for a predetermined period of time.

8. The game of claim 1 wherein the game server means further comprises means for controlling the time during which a player is permitted to provide a proposed association of a unique topic with a cell.

9. The game of claim 1 wherein the game server means and the workstation are coupled via the interne.

10. The game of claim 1 wherein the workstation is selected from a group consisting of desktop computers, laptop computers, hand-held computers and cell phones.

11. The game of claim 10 further comprising a credit card processing server in communication with the workstation and the game server.

12. A relationship identification game played by at least one player comprising:

a. at least one computer accessible database including a plurality unique topics, a separate set of game information comprising clues for each topic, and a predefined set of relationship types, at least one of the relationship types of the predefined set of relationship types selected from a group consisting of: family, co-stars, birthdays, sports, music, and shared identities;

b. a workstation having a user interface comprising (i) a display displaying a game board comprising a plurality of cells arranged such that each cell is adjacent at least one of the other cells of the plurality of cells, and (ii) at least one user input means, used by a player, for requesting clues and providing guesses; and c. a game server means, in communication with the database and the workstation and operating under program control, for (i) selecting and associating with each cell of the game board a unique topic from the plurality of unique topics by verifying the existence of a relationship type of the predefined set of relationship types between the unique topic associated with a particular cell and any unique topics associated with immediately adjacent cells of the game board and only associating a unique topic with a cell when the unique topic has a relationship type of the predefined set of relationship types with each of the unique topics associated with any cell immediately adjacent to that particular cell of the game board, (ii) from the workstation a request for a clue regarding the identity of a topic associated with a particular cell and provide to the workstation a clue, based on the game information related to that topic, which is displayed on the display of the workstation, (iii) receiving from the workstation a guess related to the topic associated with a particular cell, (iv) verifying whether the guess is correct and, if the guess is correct, and (v) sending a message to the workstation causing the topic to be displayed in the cell of the game board.

13. The game of claim 12 wherein said game server means further comprises means for evaluating a player's ability to guess topics associated with a particular cell, and reporting to the workstation a score based, at least in part, on point values assigned to the unique topics associated with the cells.

14. The game of claim 13 wherein the score is based, at least in part on, the time it takes a player to identify a unique topic associated with a cell.

15. The game of claim 13 wherein the score is based, at least in part, on a player making an incorrect guess of the unique topic associated with a particular cell.

16. The game of claim 13 wherein the game server means further comprises means for assessing a penalty against a player for making an incorrect guess of a unique topic associated with a particular cell.

17. The game of claim 12 wherein the game server means further comprises means for controlling the time during which a player is permitted to provide a guess related to a unique topic associated with a cell.

18. The game of claim 12 wherein the game server means and the workstation are coupled via the interne.

19. The game of claim 12 wherein the workstation is selected from a group consisting of desktop computers, laptop computers, hand-held computers and cell phones.

20. The game of claim 12 further comprising a credit card processing server in communication with the workstation and the game server.

* * * * *

UNITED STATES PATENT AND TRADEMARK OFFICE

CERTIFICATE OF CORRECTION

PATENT NO. : 8,286,966 B2
APPLICATION NO. : 12/638236
DATED : October 16, 2012
INVENTOR(S) : Tim Golie It is certified that error appears in the above-identified patent and that said Letters Patent is hereby corrected as shown below:

In claim 9, column 11, line 16, the word “interne” should read: -- internet --.

In claim 12, column 12, line 7, the sentence should read:
-- (ii) receiving from the workstation a request for a clue regarding --.

In claim 18, column 12, line 37, the word “interne” should read: -- internet --.

Signed and Sealed this
Fourth Day of December, 2012

David J. Kappos

David J. Kappos
*Director of the United States Patent and Trademark Office*